US005184478A

United States Patent [19]

Kutsuna et al.

[11] Patent Number: 5,184,478

[45] Date of Patent: Feb. 9, 1993

[54] REFRIGERANT APPARATUS

[75] Inventors: Kiyoharu Kutsuna, Anjo; Yoshimitsu Inoue, Toyoake, both of Japan

[73] Assignee: Nippondenso Co., Ltd., Kariya, Japan

[21] Appl. No.: 749,442

[22] Filed: Aug. 26, 1991

[30] Foreign Application Priority Data

Aug. 27, 1990 [JP] Japan ..... 2-222402

[51] Int. Cl.[5] ..... F25B 43/02; F28F 19/02

[52] U.S. Cl. ..... 62/468; 62/84; 62/503; 165/133

[58] Field of Search ..... 165/133; 62/468, 84, 62/303, 503, 512, 515, DIG. 20

[56] References Cited

U.S. PATENT DOCUMENTS

| | | | |
|---|---|---|---|
| 3,891,496 | 6/1975 | Erwin | 165/133 X |
| 3,925,149 | 12/1975 | Erwin | 165/133 X |
| 4,054,174 | 10/1977 | Haller | 165/133 X |
| 4,368,776 | 1/1983 | Negita et al. | 165/133 |
| 4,421,789 | 12/1983 | Kaneko et al. | 165/133 X |
| 4,427,034 | 1/1984 | Nagata et al. | 165/133 X |
| 4,503,907 | 3/1985 | Tanaka et al. | 165/133 |
| 4,715,196 | 12/1987 | Sugiura | 62/468 |

FOREIGN PATENT DOCUMENTS

| | | | |
|---|---|---|---|
| 49-97948 | 9/1974 | Japan . | |
| 62-195052 | 12/1987 | Japan . | |
| 3034495 | 2/1988 | Japan | 165/133 |
| 63-233299 | 9/1988 | Japan . | |
| 1-296094 | 11/1989 | Japan . | |
| 1-296095 | 11/1989 | Japan . | |

*Primary Examiner*—Herny A. Bennet
*Assistant Examiner*—Christopher B. Kilner
*Attorney, Agent, or Firm*—Cushman, Darby & Cushman

[57] ABSTRACT

A refrigerant apparatus having a compressor, a condenser, an expansion value, evaporator and an oil repellent coat. An oil repellent coat is coated inside of a low pressure refrigerant passage which lubricant is easy to adhere so that lubricant is prevented from staying inside of the refrigerant passage. Since the oil repellant coat is low affinity for oil, luricant forms guttulate on the oil repellent coat by surface tension. Since the guttulate is easy to move on the inside wall with a flow of the refrigerant, it is prevented lubricant from staying on the inside wall.

6 Claims, 3 Drawing Sheets

REFRIGERANT APPARATUS

FIELD OF THE INVENTION

The present invention relates to a refrigerant apparatus. More particularly, the present invention relates to refrigerant apparatus wherein lubricant of a compressor circulates with refrigerant in a refrigerant passage.

BACKGROUND OF THE INVENTION

A small size refrigerant apparatus used for an automotive air-conditioner has no lubricant reserver by request for miniaturizing and lightening a compressor. The refrigerant apparatus employs circulating lubrication method, wherein the lubricant circulates with refrigerant within the refrigerant passage and returns to the compressor so as to lubricate the compressor.

When the lubricant stays at a region other than compressor an amount of returned lubricant to the compressor reduces and lubrication of the compressor may be insufficient. It is required to keep circulation of the lubricant within the refrigerant passage so as to improve reliability and durability of the compressor. Japanese utility model laid open No. 62-195052 shows a method to keep circulating lubrication wherein one compressor distributes refrigerant to plurality of evaporators. When the refrigerant is not supplied to one of evaporators, the lubricant tends to stay near a junction of a refrigerant return pipe between each evaporator and the compressor. Such problem is solved by inclining return pipe downward from each evaporator near the junction of the return pipe. When the amount of circulating lubricant is increased in a circulating lubrication method, the amount of circulating refrigerant is relatively decreased and coefficient of heat transmission in a condenser and an evaporator falls off so that a refrigerating capacity falls off and consumptive power increases.

Thus, as a recent tendency, the circulating amount of lubricant is getting as small as possible. As the utility model laid-open states, lubricant adheres inside of the refrigerant passage, particularly of a low pressure refrigerant passage at the downstream of an expansion valve. When a load of a refrigerant apparatus reducing the amount of circulating lubricant is decreased, amount of returned lubricant to the compressor decreases, so that there is possibility to occur a shortage of lubricant in the compressor.

In the apparatus shown in the utility model laid open, lubricant is prevented from staying near the junction of the refrigerant return pipe in case of using plural evaporators. The apparatus, however, can not solve the problem of adhesion of lubricant to the inside wall of the low pressure refrigerant passage.

To solve the above problem, it is supported that the whole of the low pressure refrigerant passage is inclined toward an inlet of the compressor, but is is not practical to realize. It is possible to employ lubricant supplying methods other than circulating lubrication method, however, the lubricant supplying methods requires drastic change of the construction and is against the requirement of miniaturizing and lightening the refrigerant apparatus.

SUMMARY OF THE INVENTION

Accordingly, it is a primary objective of the present invention to provide a refrigerant apparatus which circulates enough amount of lubricant without employing drastic changes on the conventional apparatus.

Another object of the present invention is to provide a refrigerant apparatus which has oil repellent coat inside of the low pressure refrigerant passage partly or wholly.

A further object of the present invention is to provide a refrigerant apparatus which has oil repellent coat inside of the low pressure refrigerant passage within an area of superheated gas.

To achieve the foregoing and other objects and in accordance with the purpose of the present invention, the refrigerant apparatus of the present invention employs a compressor, a condenser, an expansion valve means, an evaporator and oil repellent coat.

In the low pressure refrigerant passage, oil repellent coat is coated inside of a low pressure refrigerant pipe and an evaporator which lubricant is easy to adhere so that lubricant is prevented from staying inside of the refrigerant passage.

Since oil repellent coat, e.g. silicon resin is low affinity for oil, lubricant forms guttulate on the oil repellent coat by surface tension.

The guttulate is easy to move on an inside wall with a flow of refrigerant and returns to the compressor with refrigerant so that it is prevented adherent lubricant from staying on the inside wall.

DETAILED DESCRIPTION OF THE PREFERRED EMBODIMENT

Figure 1:
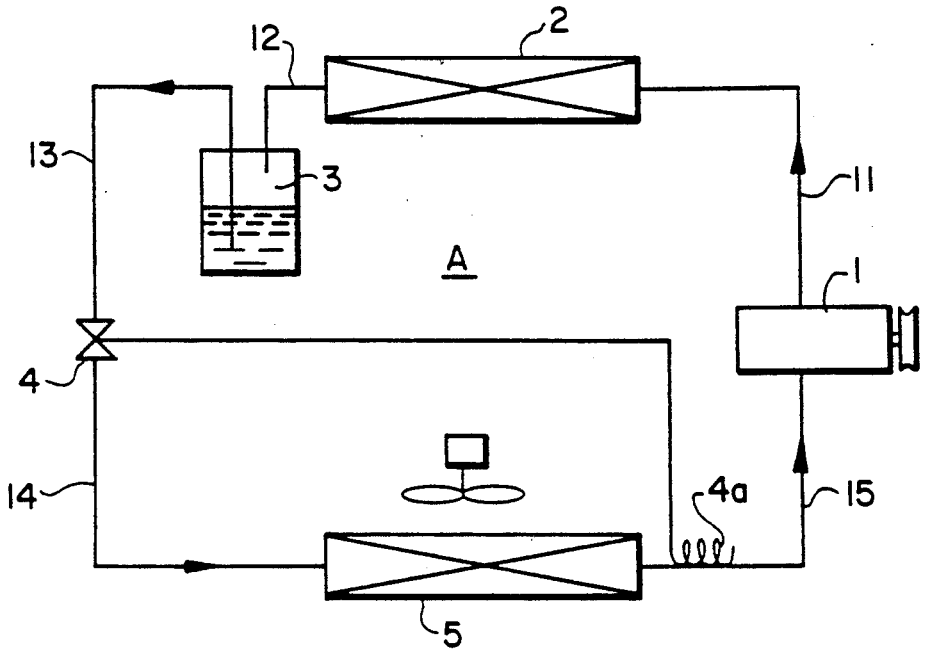
FIG. 1 shows a first embodiment of the refrigerant apparatus which adopts the present invention.

The preferred embodiment of the present invention is described hereinafter:

In FIG. 1, numeral 1 shows a compressor driven by automotive engine (not shown), etc. Numeral 2 shows a condenser to which the pressurized refrigerant compressed in the compressor 1 is introduced through a high pressure refrigerant pipe 11. The refrigerant introduced into the condenser 2 is cooled in order to be condensed. Numeral 3 shows a receiver to which the condensed refrigerant by the condenser 2 is introduced through a high pressure refrigerant pipe 12. The refrigerant is separated into a gas phase and a liquid phase. Numeral 4 shows an expansion valve corresponding to an expansion means, the refrigerant apparatus of the present invention using an expansion valve with a pressure bulb 4*a*. The liquid refrigerant in the receiver 3 is introduced into the expansion valve 4 through a high pressure refrigerant pipe 13 in order to reduce the pressure thereof.

The liquid and gas refrigerant expanded by the expansion valve 4 is then introduced into an evaporator 5 through a low pressure refrigerant pipe 14. The liquid and gas refrigerant passing through the evaporator 5 is evaporated by receiving the heat from the air so that the air introduced into the automotive passenger room, for example, is cooled. The gas refrigerant evaporator in the evaporator 5 is then introduced into the compressor 1 through a low pressure refrigerant pipe 15. Since the compressor 1 requires not to suck the liquid refrigerant, the apeture of the expansion valve 0.4 is controlled in such a manner that a predetermined temperature of the refrigerant passed through the evaporator 5 is constantly higher a predetermined value than the evaporating temperature so that the liquid refrigerant evaporates entirely at the outlet of the evaporator 5. Thus, the refrigerant in the low pressure refrigerant pipe 15 connecting between the evaporator 5 and the compressor 1 is kept in superheated gas condition.

The pressure bulb 4*a* is disposed at the outlet of the evaporator and control the apeture of the expansion valve 4 in order that the temperature of the refrigerant at the outlet of the evaporator 5 becomes a fixed temperature.

In this embodiment, a part of lubricant for compressor circulates with the refrigerant. The mixed condition of the refrigerant and lubricant is varied at each part of the refrigerant passage.

The lubricant changes into a mist within the pipe 11 from the outlet of the compressor 1 to the condenser 2 and disperses equally in the high pressure gas refrigerant.

The dispersed lubricant flows with the refrigerant. The lubricant is mixed with the liquid refrigerant in the receiver 3, the pipes 12 and the pipe 13 from the outlet of the condenser 2 to the expansion valve 4 and flows with the refrigerant. The refrigerant flows as two-phase flow comprising of gas refrigerant and liquid refrigerant in the low pressure refrigerant pipe 14 downstream of the expansion valve.

The mixed refrigerant with the liquid refrigerant and lubricant adheres to the inside wall of the pipe and flows along with the inside wall of the pipe at a speed which is slower than a flowing speed of the gas refrigerant because of being leaded by the flow of the gas refrigerant In case that refrigerant load is low and the flowing speed of the gas refrigerant drops, the power of the gas refrigerant that leads the mixed refrigerant which adheres on the inside wall of the pipe gets insufficient so that the lubricant tends to stay downstream of the expansion valve 4. When the lubricant stays in the refrigerant pipe, the amount of the lubricant returning to the compressor 1 gets insufficient so that there is a possibility to arise a problem of lubrication.

In the present invention, the above problem is solved by forming oil repellent coat inside of the refrigerant pipes 14 and 15 downstream of the expansion valve 4 and the low pressure refrigerant passage of the evaporator 5, etc.

The mixed solution with the lubricant and the liquid refrigerant does not adhere to the inside wall of the refrigerant passage. The mixed solution does not form films but droplets on the inside wall by the surface tension. Since these droplets are easy to roll on the inside wall even when the viscosity of them are high, the lubricant is supplied to the compressor 1 without staying or gathering on the inside wall even when the flow velocity of the gas refrigerant drops. In this embodiment, a silicon resin (e.g. trade name "TORAY SILICON SR 2410") is used as a material of the oil repellent coat.

The silicon resin is dissolved in solvent such as ligroin, toluene and the like. Thus, the solution is made and painted inside of the refrigerant passage by using a method described later, and further the painted solution is dried and caked so that a coat of which thickness about 0.2–1 micron is formed. Tetrafluoroethylene resin and the like are also available as the oil repellent coat material.

In the above embodiment, the oil repellent coat is formed on the whole inside wall of the low pressure refrigerant passage downstream of the expansion valve 4.

According to the development of the inventors of the present invention, it is noticed that the circulation of the lubricant is improved by disposing the oil repellent coat after the area of the second half of the evaporator 5 which the refrigerant turns superheated gas condition in the low pressure refrigerant passage. As the refrigerant in the refrigerant passage between the expansion valve 4 and the first half of the evaporator is in the condition of gas-liquid phase flow, the lubricant which is mixed with the liquid refrigerant adheres to the inside wall.

Since the mixed refrigerant includes a lot of the liquid refrigerant, the viscosity thereof is lower than that of the lubricant itself and the fluidity is comparatively high. The refrigerant, however, is kept in superheated gas condition after the area of the second half of the evaporator 5. In this area, the lubricant rate occupying the mixed refrigerant is increasing because the refrigerant in the mixed refrigerant evaporates. Thus the viscosity and the temperature of the mixed refrigerant increases and at last reaches the viscosity of the lubricant itself so that the mixed refrigerant which adheres to the inside will becomes easy to gather and stay.

Consequently, the main factor preventing the lubricant from circulating is that the lubricant adheres to the inside wall corresponding to the extent of superheated gas area (namely, the second half of the evaporator 5 shown in FIG. 1 and the refrigerant pipe 15) in the low pressure refrigerant passage.

Figure 2:
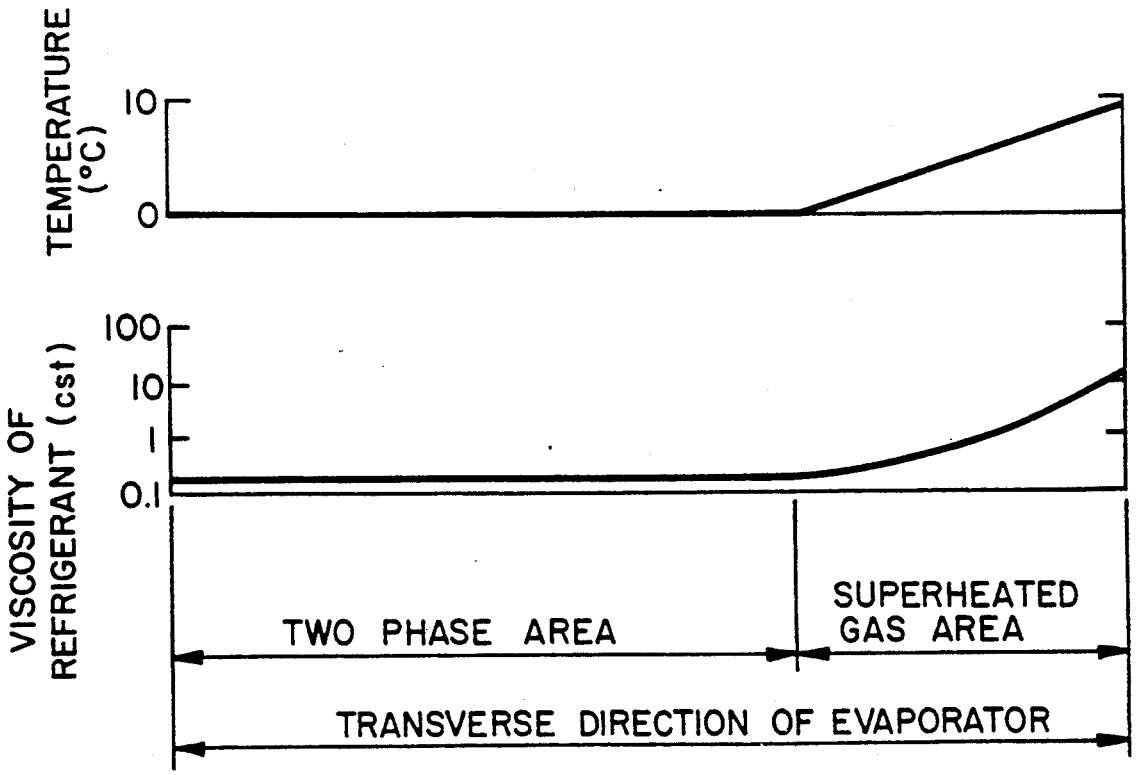
FIG. 2 is a diagram explaining variation of viscosity of refrigerant mixed with lubricant and variation of temperature thereof.

FIG. 2 shows calculating results of a temperature change of the refrigerant passing through the evaporator 5 and a viscosity change of the mixed refrigerant consisting of liquid refrigerant and lubricant and adhering to the inside wall. As shown in FIG. 2, the viscosity of the mixed refrigerant is low when the refrigerant is in gas-liquid (two) phase condition at the first half of the evaporator and the viscosity of that is close to the viscosity of the liquid refrigerant. The viscosity of the mixed refrigerant rises suddenly when the refrigerant temperature rises at the second half of the evaporator 5 and the refrigerant moves to the superheated gas condition. Since the viscosity of the refrigerant is getting close to the viscosity of the lubricant itself, the refrigerant becomes easy to gather and stay.

Figure 3:
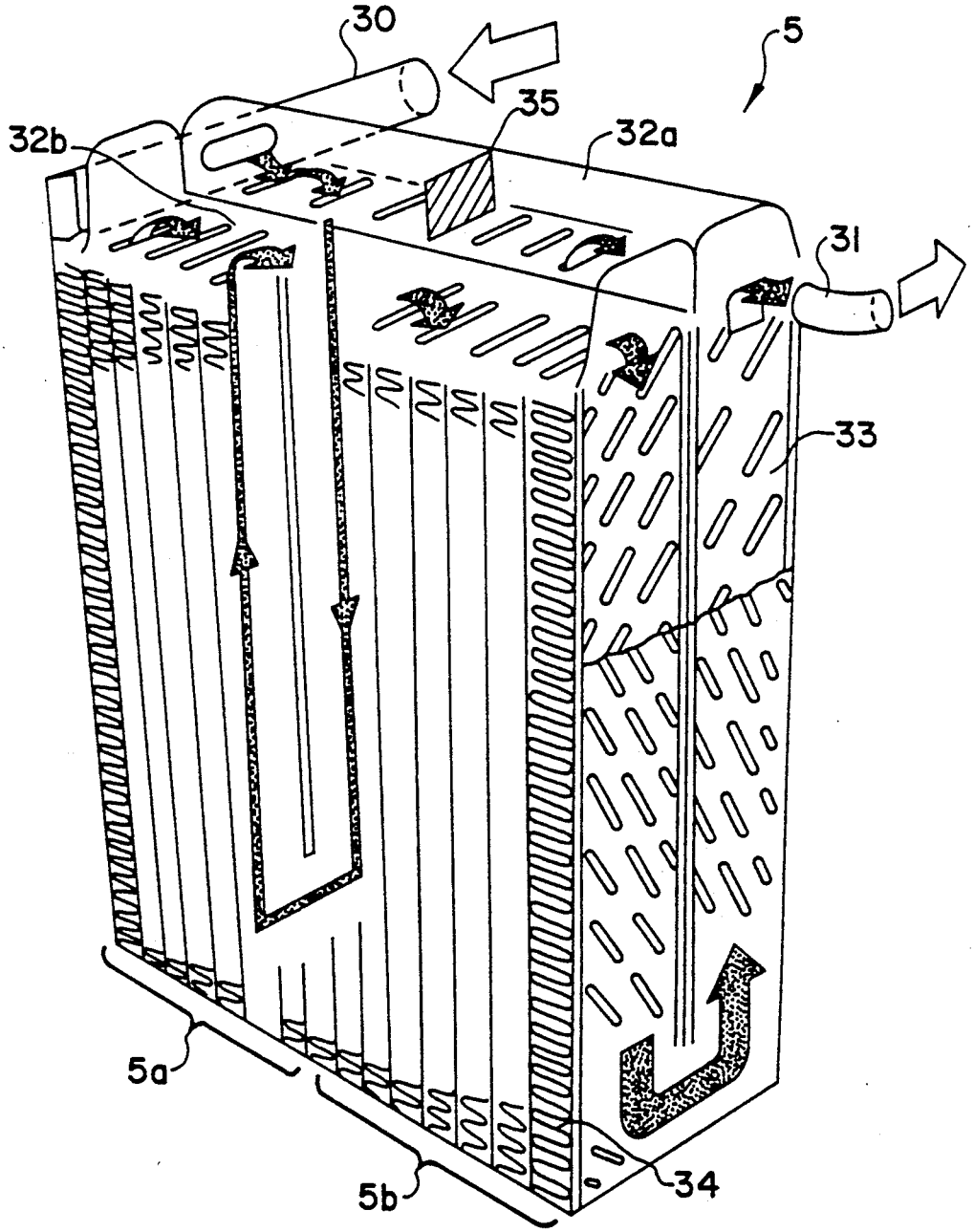
FIG. 3 is a perspective view showing the evaporator shown in FIG. 1.

A method to form the oil repellent coat in the refrigerant passage of the evaporator is described hereinafter. In FIG. 3, the evaporator 5 has refrigerant passages 33 formed by soldering aluminum alloy plates, cooling fins 34 made of aluminum alloy and soldered outside of the refrigerant passage 33. A refrigerant inlet pipe 30, an outlet pipe 31 and headers 32*a* and 32*b* connecting inlet and outlet of each refrigerant passage 5*a* are disposed at the top of the evaporator 5. In the center of header 32*a*, a partition 35 is provided so as to separate the evaporator 5 into a previous port 5*a* and a latter port 5*b* (corresponding to a first half and a second half respectively).

The refrigerant flows into the evaporator 5 through the inlet pipe 30 to the inlet side of the header 32*a*. The refrigerant flows each refrigerant passage 33 at the previous portion 5*a* and turns at the bottom of the evaporator 5 as shown by the black arrow. The refrigerant gathers from each refrigerant passage 33 at the previous portion 5*a* of the header 32*b*. After that, the refrigerant flows into each refrigerant passage 33 disposed the later portion 5*b* of the header 32*b*. At the bottom of the evaporator, the refrigerant turns as shown by black arrow and gathers from each refrigerant passage 33 at the later portion 5*b* of the header 32*a*. The refrigerant flows out through the outlet pipe 31. The refrigerant flows into the evaporator 5 from the inlet pipe 30 with the gas-liquid phase condition. The refrigerant is evaporated by receiving the heat from the air at the previous portion 5*a* through the cooling fin 34. The refrigerant becomes the superheated gas condition by receiving the heat from the air at the later portion 5*b*.

In another embodiment, oil repellent silicon resin coat is formed on the latter portion 5*b* which becomes superheated condition in the refrigerant passage of the evaporator 5. Silicon resin (trade name "TORAY SILICON SR 2410") is used as a solution dissolving in solvent such as ligroin, toluene and the like. The solution is injected from the outlet pipe 31 of which amount is equal to the cubic content of the latter portion 5*b* of the evaporator 5 and fill up the latter portion 5*b* of the evaporator. After completion of filling up, pressure gas (e.g. pressurized air) is blown into the evaporator 5 through the inlet pipe 30 of the evaporator, whereby silicon resin solution is discharged from the outlet 31 and adheres to the inside wall of the refrigerant passage at the latter portion of the evaporator, so that the solution coating is formed on the inside wall. Then the evaporator 5 is heated in high temperature oven in order to evaporate the solvent and solidity the silicon resin coat. After the heating operation for about an hour at about 200° C., the silicon resin coat of which thickness is 0.2–1 micron is formed firmly on the wall of the latter portion 5*b* and the outlet pipe 31 of the evaporator 5. The evaporator which is two stages type is explained in this embodiment, however the evaporator which is one stage type or more than three stages type can form the coat by the same method.

Figure 4:
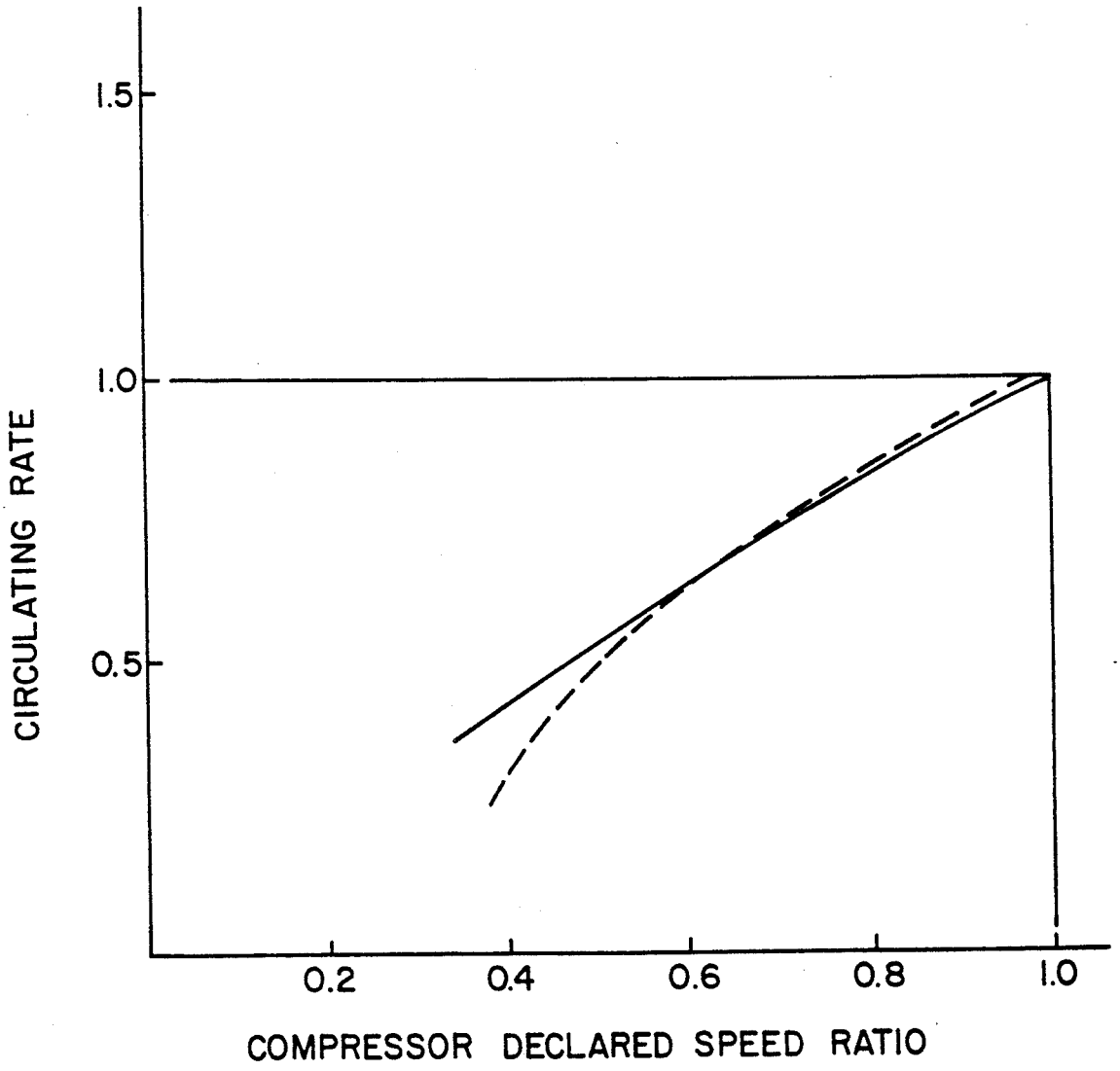
FIG. 4 is a diagram explaining relation of circulating rate to a compressor declared speed ratio.

FIG. 4 shows the amount of circulating lubricant compared the case that oil repellent coat is formed in the latter portion 5*b* of the evaporator 5 and inlet pipe 15 (superheated gas area in the low pressure refrigerant passage) with the case that oil repellent coat is not formed in the low pressure refrigerant passage at all. In FIG. 4, an abscissa shows compressor declared speed ratio and an ordinate shows circulating rate which is defined following formula;

Circulating rate = (flow of the lubricant)/(flow of the refrigerant + flow of the lubricant)(percentage by weight).

The circulating rate means the relative amount defining the amount when the compressor rotates at 1000 rpm in case oil repellent coat is not formed as 1. In FIG. 4, the solid line shows the case wherein the oil repellent coat is formed, and the dotted line shows the case wherein the oil repellent coat is not formed at all. Certainly, each line shows the measured result in the same condition. As shown in FIG. 4, in case oil repellent coat is formed, even the refrigerant current gets low and compressor declared speed ratio is under 0.6 the circulating rate of the apparatus having oil repellent coat is highly maintained compared with the circulating rate of the apparatus having no oil repellent coat so that gathering and staying by the lubricant is decreasing.

Consequently, minimum working speed of the compressor can be reduced substantially. When the present invention can apply to a variable capacity compressor, a low limit capacity of a variable capacity compressor can be reduced. Since refrigerant apparatus of the present invention, as stated above, has oil repellent coat which is formed on the inside wall of the low pressure refrigerant passage, the amount of circulating lubricant is highly maintained even the time of low load driving when the amount of circulating refrigerant drops so that the compressor is improved in reliability and durability.

Further, it is available to form the oil repellent coat only at the refrigerant superheated gas area in the low pressure refrigerant passage.

Thus, the degradation of heat transmission coefficient of the evaporator is kept at a minimum, the degradation which is caused by forming the oil repellent coat and it can reduce the cost for forming the oil repellent coat.

What is claimed is:

1. A refrigerant apparatus having a refrigerant passage through which refrigerant circulates, comprising:

a compressor sucking, compressing and discharging refrigerant;

a condenser connected to an outlet of said compressor and condensing the refrigerant discharged from said compressor;

an expansion means connected to an outlet of said condenser for reducing the pressure of the refrigerant;

an evaporator desposed between an outlet of said expansion means and an inlet of said compressor for evaporating the refrigerant; and oil repellent coat coating at least a part of an inside of a low pressure refrigerant passage between downstream of said outlet of said expansion valve means and upstream of said inlet of said compressor.

2. A refrigerant apparatus according to claim 1, wherein said low pressure refrigerant passage is formed a first connecting pipe for connecting the outlet of said expansion means and the inlet of said evaporator, an evaporating refrigerant passage of said evaporator and a second connecting pipe for connecting the outlet of said evaporator and the inlet of said compressor.

3. A refrigerant apparatus according to claim 2, wherein said oil repellent coat is formed at an inside of said evaporating refrigerant passage of said evaporator where the refrigerant is in superheated gas area.

4. A refrigerant apparatus according to claim 2, wherein said oil repellent coat is formed inside of said evaporating refrigerant passage of said evaporator between the second half and an outlet of said evaporator and said connecting means between said evaporator and said compressor.

5. A refrigerant apparatus according to claim 2, wherein said oil repellent coat is silicon resin.

6. A refrigerant apparatus according to claim 2, wherein the thickness of said oil repellent coat is 0.2–1.0 micron.

* * * * *